US008510983B2

(12) United States Patent
Larue

(10) Patent No.: US 8,510,983 B2
(45) Date of Patent: Aug. 20, 2013

(54) PIVOT MOUNT FOR FIREARM SIGHTING DEVICES AND ACCESSORIES

(76) Inventor: Mark C. Larue, Leander, TX (US)

( * ) Notice: Subject to any disclaimer, the term of this patent is extended or adjusted under 35 U.S.C. 154(b) by 193 days.

(21) Appl. No.: 13/136,825

(22) Filed: Aug. 11, 2011

(65) Prior Publication Data

US 2013/0036650 A1 Feb. 14, 2013

(51) Int. Cl.
*F41G 11/00* (2006.01)

(52) U.S. Cl.
USPC ..... 42/148; 42/124; 42/128

(58) Field of Classification Search
USPC ..... 42/124–128, 148
See application file for complete search history.

(56) References Cited

U.S. PATENT DOCUMENTS

| | | | | | |
|---|---|---|---|---|---|
| 2,367,762 | A * | 1/1945 | Eiane | 42/148 |
| 2,527,289 | A * | 10/1950 | Allen | 42/128 |
| 2,529,801 | A * | 11/1950 | Fisk | 42/128 |
| 2,629,175 | A * | 2/1953 | Merritt | 42/128 |
| 2,639,507 | A * | 5/1953 | Pachmayr | 42/128 |
| 2,644,237 | A * | 7/1953 | Pachmayr | 42/128 |
| 2,710,453 | A * | 6/1955 | Beverly | 42/128 |
| 2,803,880 | A * | 8/1957 | Weaver | 42/128 |
| 3,178,823 | A * | 4/1965 | Lipski | 42/126 |
| 4,092,793 | A * | 6/1978 | Ricks | 42/128 |
| 4,092,899 | A * | 6/1978 | Lienau | 89/1.816 |
| 4,461,087 | A * | 7/1984 | Norman | 42/128 |
| 6,026,580 | A * | 2/2000 | LaRue | 42/127 |
| 6,705,037 | B2 * | 3/2004 | Van Kirk | 42/126 |
| 7,272,904 | B2 * | 9/2007 | Larue | 42/127 |
| 7,367,152 | B2 * | 5/2008 | Samson | 42/128 |
| 7,730,655 | B2 * | 6/2010 | Spuhr | 42/127 |
| 7,908,782 | B1 * | 3/2011 | LaRue | 42/128 |
| 8,128,047 | B1 * | 3/2012 | Larue | 248/316.1 |
| 8,196,332 | B2 * | 6/2012 | Brentzel | 42/125 |
| 8,336,247 | B2 * | 12/2012 | Haering | 42/127 |
| 8,424,234 | B2 * | 4/2013 | Carlson et al. | 42/90 |
| D681,767 | S * | 5/2013 | Li et al. | D22/109 |
| 8,438,773 | B2 * | 5/2013 | Carlson et al. | 42/90 |

* cited by examiner

*Primary Examiner* — Michael David
(74) *Attorney, Agent, or Firm* — James L. Jackson

(57) ABSTRACT

A pivot mount base is assembled to or removed from the sight mounting rail of a firearm by a lever actuated cam energized rail clamping mechanism. A pivot shaft is fixed within an axially oriented pivot passage of the mount base and defines spaced external bearing surfaces. A pivotal accessory support device defines spaced pivot receptacles having a portion of said pivot mount base located therebetween and has bearing receptacles receiving the pivot shaft. The accessory support device is moveable both linearly and rotatably relative to the fixed pivot shaft and is urged toward a locked position with a locking pin by a compression spring and is moved against the spring force to free the accessory support device for manual rotational movement to a precision aiming position and to a laterally offset position.

15 Claims, 4 Drawing Sheets

PIVOT MOUNT FOR FIREARM SIGHTING DEVICES AND ACCESSORIES

BACKGROUND OF THE INVENTION

1. Field of the Invention

The present invention relates generally to firearms, and more particularly to firearm sighting systems, including mounts for attachment of sighting devices to firearms. Even more specifically, the present invention concerns a pivot mount by which a particular firearm sighting device, such as an optical or laser sighting device is releasably mounted to the sight mounting rail of a firearm, such as a tactical firearm, by a locking lever operated clamp mechanism. When so mounted, a sight support portion of the mount is pivotally moveable between an operative position, at which the sighting device is useable for the purpose of sighting the firearm on a target, and an inoperative position, at which the sighting device is positioned out of the normal line of sight of the firearm. The present invention also concerns a pivot mount for a firearm sighting device or other firearm related implement that is adapted for manual unlocking and pivotal movement to a sighting position or a laterally offset position, without necessitating the use of any tools or other equipment. The present invention also permits an auxiliary sighting device to be selectively employed in series with a primary sighting device when desired.

2. Description of the Prior Art

Virtually all firearms are provided with mechanical sighting devices, virtually all of which are selectively adjustable by the user to accomplish bullet strike as nearly as possible to a point of aim. Firearms, particularly rifles, have for a considerable period of time, been provided with mechanical sights, typically referred to as "iron sights", and with additional sighting devices, such as telescopes and other optical sighting devices. At times, if the mechanical sighting device cannot be readily used with an optical sighting device in place, it is desirable to remove the optical sighting device from the firearm. Typically, removal of an optical sighting device from a firearm requires the use of certain tools and equipment and the risk of losing sight mounting or adjusting parts, especially if such an activity is carried out in a field environment. Moreover, removal of a sighting device from a firearm inevitably results in the loss of zero, thus requiring the firearm to be again sighted in after the sighting device has been re-installed on the firearm. For these reasons, telescope sighting devices and sight mounts have been developed to permit hinged or pivotal movement of a telescope from an operative sighting position to a laterally off-set inoperative position. These improvements enable a telescope to be pivotally moved to and from a sighting position on a firearm without requiring re-adjustment of the sight. U.S. Pat. Nos. 2,639,507 and 2,644,237 of Pachmayr and U.S. Pat. No. 2,803,880 of Weaver are representative of pivotally mounted telescopes of this nature. More recent pivot mount mechanisms are presented by U.S. Pat. No. 7,367,152 of Samson and U.S. Pat. No. 7,908,782 of LaRue. Additionally, a spring urged pivot mount mechanism having a linearly moveable lock release shaft has been manufactured and sold by Janna and is known as the "Janna flip-up mount". A torsion spring is loaded when the mount of Janna is pivotally moved to its aligned position for optical sight use. When a lock release shaft is manually moved forwardly by the user, the Janna mount is unlatched or released and the force of the torsion spring will cause pivoting movement of the mount and the optical sight to an out-of-the-way position, so that iron sights of the firearm can be used.

More recently, especially in the tactical firearm environment, various firearm sighting devices are often mounted on firearms in tandem or series so that the cumulative benefit of dual sighting devices can be employed to establish specifically desired sighting for firearm use. For example, an optical sighting device and a thermal or night vision sighting device can be used in tandem to provide the user with the capability for using optical sighting during conditions of poor light. Laser sighting devices are used in conjunction with telescope sights to provide the user with the benefits of a magnified image of a target and to permit laser sighting of the target. At times, it is beneficial to eliminate a sighting device from the line of sight, but to do so ordinarily requires the use of tools or other equipment. In the tactical environment, military or law enforcement personnel do not ordinarily have sufficient available time for sight removal or installation, so there is little need for changes of sighting devices. However, if a sighting device can be moved to an out-of-the-way position to permit a desired firearm use, and can then be returned to its original position without disturbing the zero of the sighting system of the firearm, the user of the firearm could have a decided advantage, especially if the firearm is of the tactical variety.

Even more recently tactical personnel have been provided with the capability for efficient release and removal of an optical sighting device from a firearm having a mounting rail and re-installing the sighting device precisely to its previous zero condition. U.S. Pat. No. 7,272,904 of Mark C. LaRue concerns an adjustable locking lever operated Picatinny rail clamp mechanism providing this sight removal and replacement capability while maintaining a previously established zero.

There is a current need, especially in the field of tactical firearms, to provide a mounting device for optical sighting devices and other sight related devices that has a pivotal capability for movement of sighting devices between operative and inoperative positions without requiring the use of tools or special equipment of any nature. Especially in the tactical environment is desirable to provide a pivotal optical sight mount that secures an optical sight device against inadvertent movement or noise even when the sighting device has been moved to its inoperative position. It is also desirable to provide a pivot mount that can be easily and quickly removed from a firearm together with its optical sighting device, transported to a site for use, and then re-installed on the firearm in sight zero condition, so that the firearm can be immediately used for precision firing.

SUMMARY OF THE INVENTION

It is a principal feature of the present invention to provide a novel pivot mount mechanism for optical sighting devices, other sight related implements and accessories, that permits the user of a firearm to quickly and efficiently manually release the pivot mount from its operative position and rotate the pivot mount and its auxiliary sighting device to an inoperative or out-of-the-way position.

It is another feature of the present invention to provide a novel pivotal firearm sight mount mechanism that stabilizes a sight mount and its sighting device at both the operative and inoperative positions of the sighting device to prevent any inadvertent movement or noise of the sighting device as the firearm is handled.

It is also a feature of the present invention to provide a novel pivotal firearm sight mount mechanism that is incorporated with a lever actuated sight rail clamping mechanism, thus permitting the entire pivot mount mechanism to be removed from a firearm and replaced without losing the previously sighted zero of the sighting mechanism.

It is an even further feature of the present invention to provide a novel pivotal firearm sight mount mechanism that is selectively moveable between operative and inoperative positions relative to a firearm without any requirement for the use of tools or special equipment to permit such movement.

Briefly, the various objects and features of the present invention are realized by providing a pivot mount base that is assembled to or removed from the sight mounting rail of a firearm by a lever actuated cam energized rail clamping mechanism. The pivot mount base is provided with an integral pivot projection within which is defined a pivot passage that is oriented such that it is in precision parallel relation with the bore of the barrel of the firearm to which the mount is secured. The pivot mount base is provided with an integral pivot projection having a pivot shaft passaged formed therein. A pivot shaft having an externally threaded section is threaded into an internally threaded section of the pivot shaft passage, thus establishing a fixed relation of the pivot shaft relative to the pivot projection and mount base. If desired, any other shaft mounting system may be employed to ensure that the pivot shaft is disposed in fixed relation with the pivot mount base. A pivotal sight or accessory support device is pivotally mounted to the pivot mount base and is selectively moveable to a sighting position and to a laterally offset position and is releasably locked against inadvertent movement at both the sighting position and the laterally offset position. Spaced pivot projections are defined by the pivotal sight or accessory support device and have greater spacing than the axial dimension of the pivot projection, thus permitting axial movement of the pivotal sight or accessory support device relative to the pivot projection. The spaced pivot projections each define pivot openings that are disposed in axial alignment and establish bearing support and both axial and rotational movement in relation with the fixed pivot shaft so that the pivotal sight or accessory support device is both linearly and rotationally moveable relative to the pivot shaft and relative to the mount base.

The pivot projection also defines at least one and preferably a pair of locking recesses that are rotationally positioned about 90° apart. One of the locking recesses is located for precision positioning pivotal sight or accessory support device to facilitate precise alignment of an auxiliary sighting device with respect to a target and with respect to a primary sighting device. The other of the locking recesses is positioned so that an auxiliary sighting device can be rotated from its precision sighting position to a laterally offset, out-of-the-way or inoperative position and is releasably locked at this laterally offset position to prevent inadvertent movement and noise. A locking pin or other locking device is secured in fixed relation with the pivotal sight or accessory support device and is disposed for locking engagement within either of the locking recesses, depending on the position of the pivotal sight or accessory support. A compression spring is retained within a spring receptacle that defines a part of the pivot passage of the pivot projection and thus is positioned about a portion of the pivot shaft. A spring force is applied by the compression spring to the pivot projection and to the pivotal sight or accessory support device and urges the pivotal accessory or sight support device to a position causing the locking pin to establish locking engagement with one of the locking recesses.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

However, it is to be noted that the appended drawings illustrate only a typical embodiment of this invention and are therefore not to be considered limiting of its scope, for the invention may admit to other equally effective embodiments. In the Drawings.

DETAILED DESCRIPTION OF PREFERRED EMBODIMENT

Figure 1:
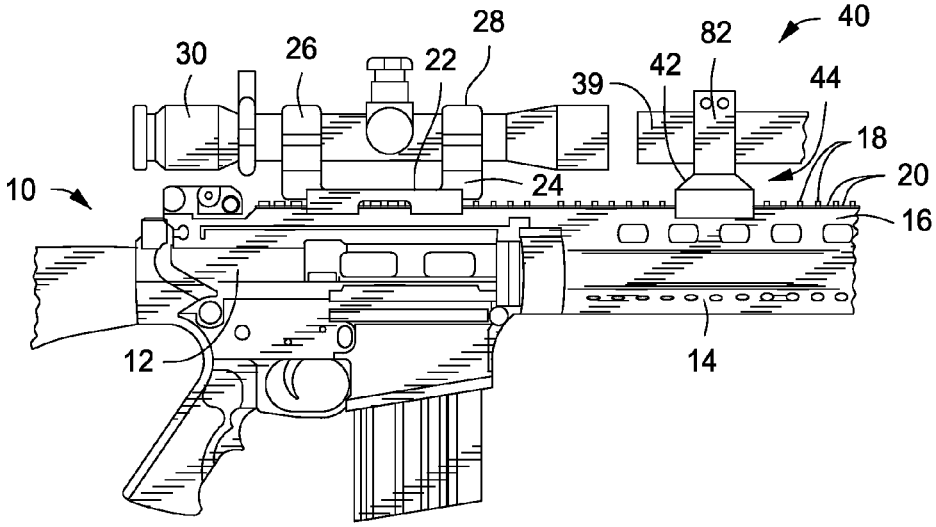
FIG. 1 is an elevation view showing an intermediate part of a tactical firearm having a Picatinny sight mounting rail extending along the receiver and hand-guard of the firearm and further showing a primary sighting device and an auxiliary sighting device, each being independently mounted to the mounting rail, and with the auxiliary sight mounting mechanism being a pivot mount embodying the principles of the present invention.
Figure 2:
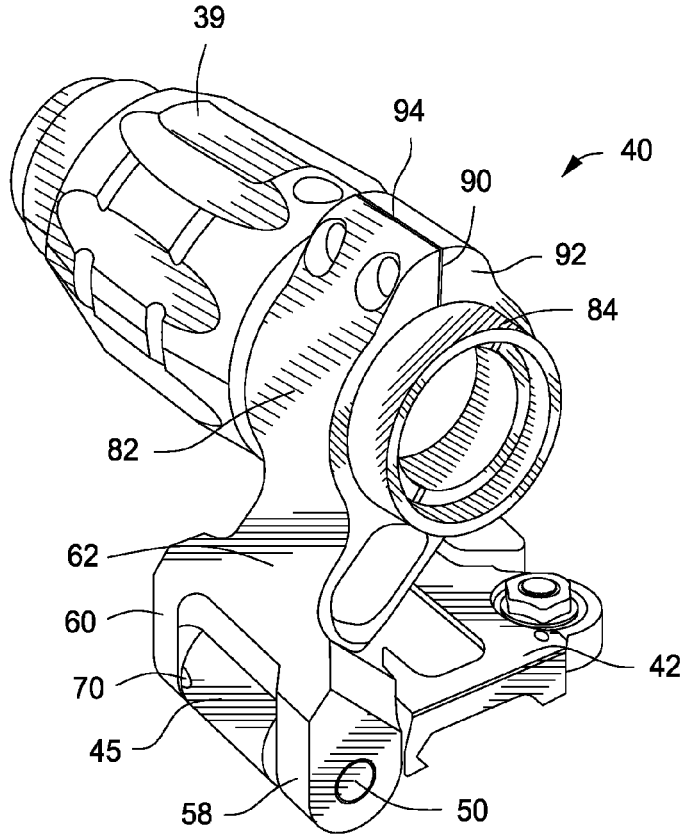
FIG. 2 is an isometric illustration showing the pivot mount of the present invention in its sighting position and with an auxiliary sighting device being supported by a mount ring assembly for positioning in series with the primary sighting device.
Figure 3:
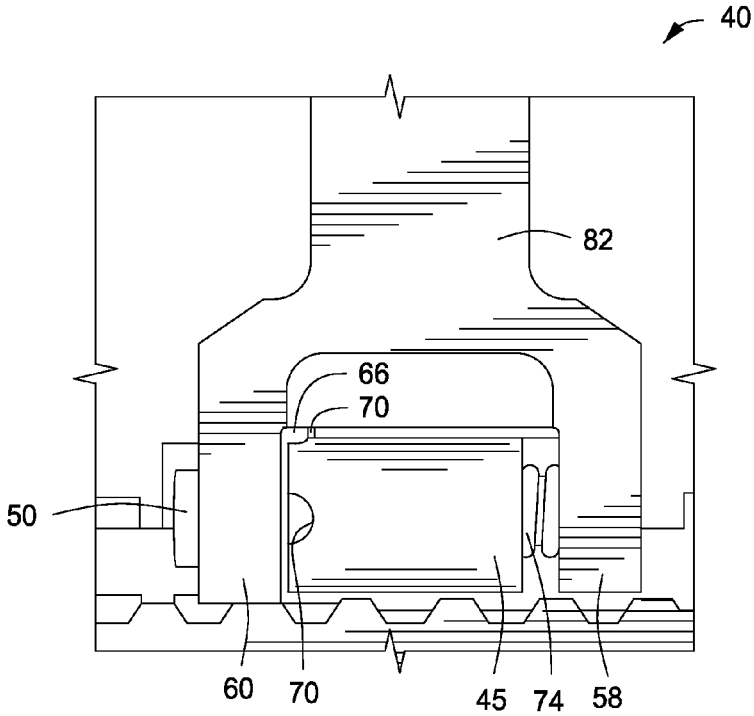
FIG. 3 is an elevation view showing a side portion of the pivot mount mechanism of FIGS. 1 and 2 in greater detail.

With reference now to the drawings and first to FIGS. 1 and 2, an intermediate part of a tactical firearm is shown generally at 10 and has a receiver 12 to which is mounted a hand-guard 14 that encloses a barrel, not shown. A sight or accessory mounting rail 16, such as a Picatinny rail, Weaver rail or the like is mounted to or formed on the receiver and handguard. The mounting rail defines a multiplicity of equally spaced ridges 18 and grooves 20 that provide for selective location of sighting devices and other accessories along the length of the mounting rail. As shown, a sight mount mechanism 22 is clamped or otherwise mounted to the mount rail 16 and includes a sight support structure 24 having mounting rings 26 and 28 that provide for support and stability of a primary optical sighting device 30, typically referred to as a telescope. However, the optical sighting device 30 may be any other type of firearm sight mechanism, such as a laser sight, infrared sight, etc. without departing from the spirit and scope of this invention. The sight mount mechanism 22 is a lever actuated sight mount rail clamp mechanism that is constructed and operates essentially according to the teachings of U.S. Pat. No. 7,272,904 of LaRue, which patent is incorporated herein by reference for all purposes. The lever actuated sight mount rail clamp mechanism permits the primary sighting device to be easily and quickly removed from the mounting rail and then re-mounted to the mounting rail without losing its sighting zero.

An auxiliary sight mount mechanism, shown generally at 40 is shown to be releasably mounted to the forward portion of the mounting rail 16. The auxiliary sight mount mechanism is positioned ahead of and in series with the primary sighting device and is shown in FIGS. 1 and 2 with its auxiliary sighting device or other accessory 39 normally locked in sighting alignment with the primary optical sighting device 30. The mounting mechanism for the auxiliary sighting device is capable of being moved linearly to achieve unlocking and is then capable of pivotal movement to an inoperative position or an out- of-the-way position, thus enabling the user of the firearm to employ only the primary sighting device if desired. The auxiliary firearm sighting mechanism incorporates a mount base 42 that is also preferably in the form of a lever actuated clamp mechanism embodying the teachings of U.S. Pat. No. 7,272,904 of LaRue. However, it should be borne in mind that the mounting base 42 may be mounted to any portion of a firearm mechanism according to conventional mounting principles, without departing from the spirit and scope of the present invention.

Figure 4:
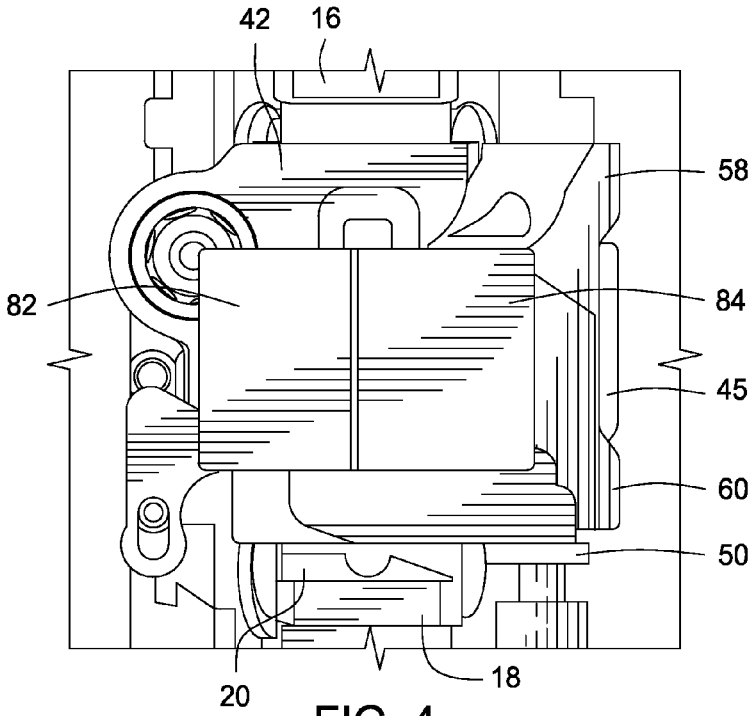
FIG. 4 is a top plan view, showing the operative sighting position of the pivot mount mechanism of FIGS. 1-3.
Figure 5:
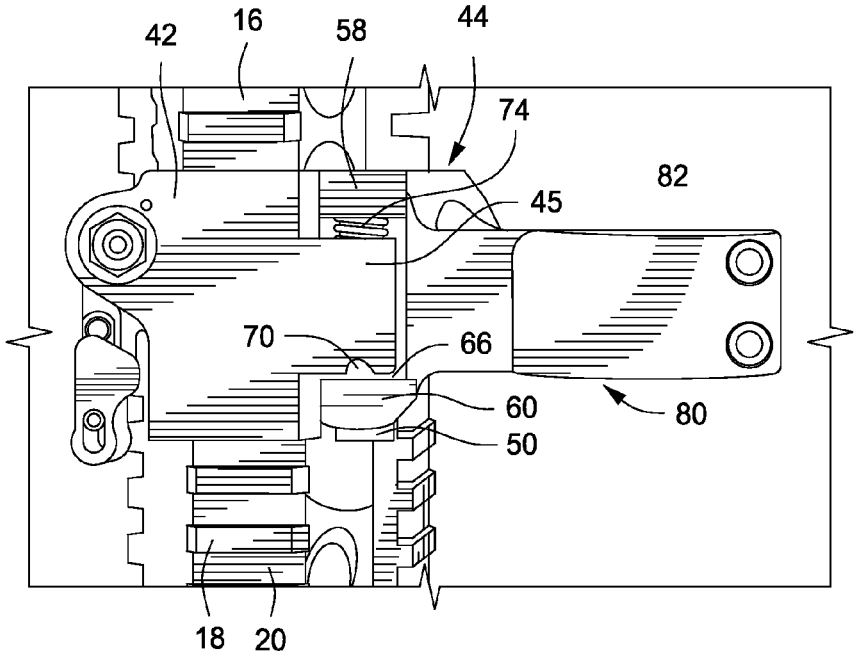
FIG. 5 is a top plan view, showing the inoperative, laterally offset position of the pivot mount mechanism of FIGS. 1-3.
Figure 6:
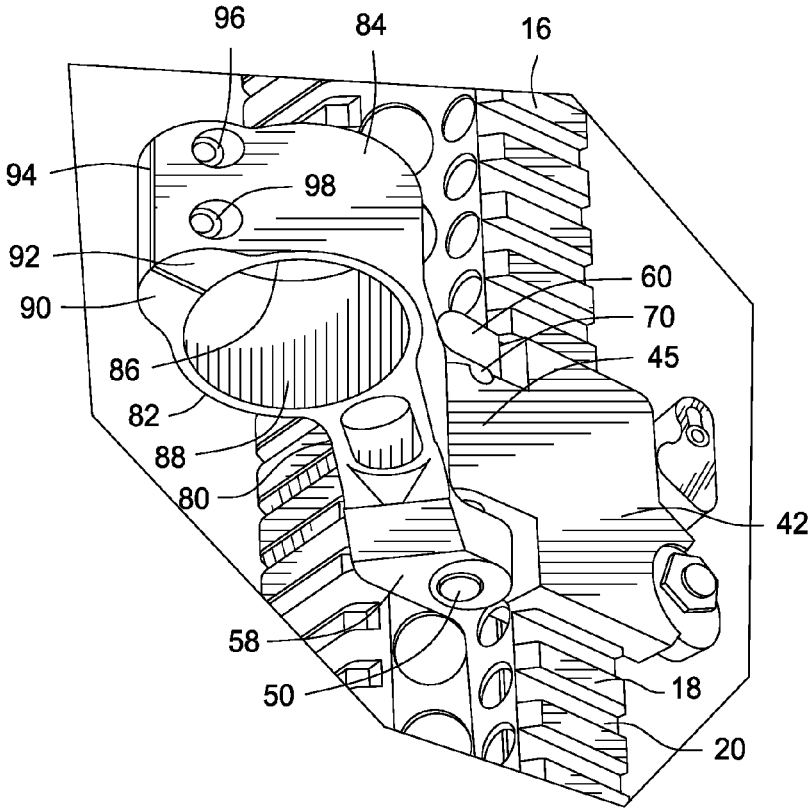
FIG. 6 is another top plan view of the pivot mount mechanism of FIGS. 1-3, showing the inoperative, laterally offset location of the sight positioning mechanism.
Figure 7:
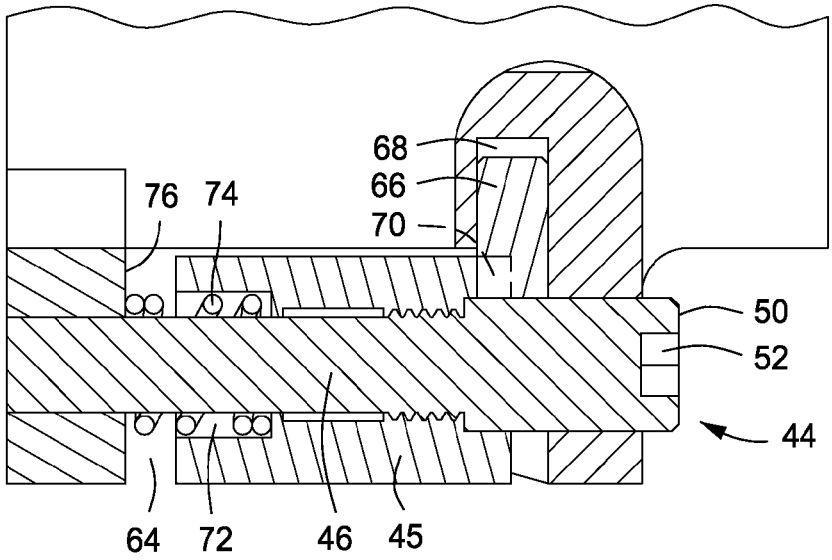
FIG. 7 is a fragmentary section view showing the pivot mechanism of the present invention in its locked condition, with the pivot mount mechanism positioned at its operative sighting position.
Figure 8:
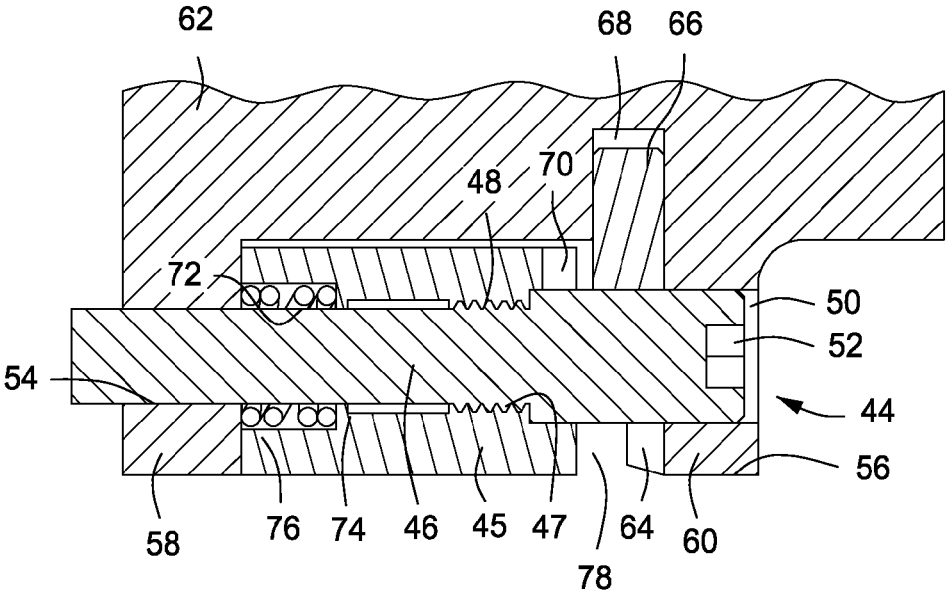
FIG. 8 is another fragmentary section view showing the condition of the pivot mechanism with the pivotal accessory support device of the sight mount mechanism retracted to its unlocked position against the force of its compression spring in preparation for pivotal rotation of the pivotal sight or accessory support device about a fixed pivot shaft.

The mounting base 42 incorporates a pivot mechanism, shown generally at 44, and best shown in the top plan view of FIG. 4, the isometric illustration of FIG. 5 and the section views of FIGS. 6 and 7. The pivot mechanism 44 is defined by a pivot projection 45 that is preferably integral with the mount base 42 and extends laterally from the mounting base and is machined to define a pivot passage 46 that has precision alignment in parallel relation with the bore of the firearm barrel. The pivot passage 46 has an internally threaded section 47 that receives an externally threaded section 48 of a pivot shaft 50 and establishes a fixed relation of the pivot shaft with respect to the pivot projection 45 of the mount base 42. The pivot shaft defines a drive receptacle 52 which is designed to receive a pivot pin driving implement, such as an Allen wrench, star drive wrench or a Phillips or flat head screw driver. The pivot shaft 50 is thus threaded into the pivot passage of the pivot projection 45 and is disposed in fixed and releasable relation with the pivot projection. The pivot shaft receptacles 54 and 56 of spaced pivot projections 58 and 60 of a pivotal sight or accessory support device 62 have bearing engagement with spaced cylindrical surfaces of the pivot shaft 50 and are both rotatably moveable and linearly moveable relative to the fixed pivot shaft. The spaced pivot projections 58 and 60 of the pivotal accessory support device 62 define a receptacle 64, within which the pivot projection 45 is located. The receptacle 64 has greater axial spacing as compared with the axial dimension of the pivot projection 45, thus permitting axial movement of the sight or accessory support device 62 relative to the pivot projection. This feature permits axial unlocking movement of the sight or accessory support device 62 in preparation for its rotation to the operative sighting position or to the inoperative laterally offset position.

As shown in the section views of FIGS. 6 and 7 the pivotal accessory support device 62 is moveable both linearly and rotatably relative to the pivot projection 45, which permits the pivotal accessory support device 62 to be manually unlocked from either its operative or inoperative positions by linear movement and then permits the pivotal accessory support device 62 to be manually rotated to the operative or inoperative position. The operative position of the pivotal accessory support device 62 is also referred to as the aiming position at which an optical sighting device or other accessory is releasably locked at a position enabling precision aiming of the firearm at a target. At this operative position the auxiliary sighting device is disposed in precision registry or alignment with the primary sighting device 30. At its inoperative position, the pivotal accessory support device 62 is releasably locked at a position substantially 90° offset from the operative or aiming position, at which the auxiliary sighting device, or other accessory supported thereby, is located at a laterally offset or out-of-the-way position to permit independent use of the primary sighting device 30.

A locking pin 66 is press-fitted or otherwise secured in fixed relation within a locking pin receptacle 68 and is thus disposed in fixed relation with the pivotal accessory support device 62. The locking pin 66 is composed of a hardened, wear resistant metal material, such as hardened steel or titanium. The pivot projection 45 is machined to define a pair of locking recesses 70 which have approximately 90° angularly offset relation with one another and which have a generally U-shaped cross-sectional configuration for receiving the locking pin 66 to establish precision positioning of the pivotal accessory support device 62. The locking pin 66 is preferably of cylindrical cross-sectional configuration and the locking recesses each define internal side surfaces that are engaged by the cylindrical pivot pin to achieve precision positioning of the pivotal accessory support device 62 relative to the pivot projection 45 of the mount base 42.

The pivot projection 45 of the mount base is also machined to define an internal spring receptacle 72 within which is positioned a compression spring 74. The compression may conveniently take the form of a helical spring, leaf spring, Belleville spring or an urging means of any other suitable form. The compression spring is arranged to direct a spring force against the annular planar shoulder surface 76 of the pivot projection 58, urging the pivotal accessory support device 62 to the right, as shown in FIGS. 6 and 7, to establish locking of the pivotal accessory support device 62 relative to the pivot projection 45 of the mount base 42 as shown in FIG. 6. To unlock the pivotal accessory support device 62 from the locked position shown in FIG. 6, in preparation for its rotation, a manual force is applied to the pivotal accessory support device 62, against the force of the compression spring. When the spring force has been overcome by this manually applied force, the pivotal accessory support device 62 will be moved linearly from its locked position, shown in FIG. 6, to the unlocked position shown in FIG. 7, thus withdrawing the locking pin 66 from the locking recess 70. At this point, the pivotal accessory support device 62 will be free for pivotal rotation about the pivot shaft 50 in either rotational direction, though the structural interrelation of the mount base and the pivotal accessory support device 62 may restrict rotation of the pivotal accessory support device 62 significantly beyond its operative and inoperative positions.

After sufficient rotation of the pivotal accessory support device 62 has taken place to clear the locking pin from one of the locking recesses 70, the manual unlocking or retracting force may be released, thus permitting the locking pin 66 to engage and slide along the extent of the annular end surface 78 of the pivot projection 45. When sufficient rotation of the pivot pin has occurred to position the locking pin 66 in registry with one of the locking recesses, the force of the compression spring will move the pivotal accessory support device 62, thus moving the locking pin into a selected one of the locking recess. This movement establishes locking of the pivotal accessory support device 62 at the selected operative or inoperative position. For selective positioning of the pivotal accessory support device 62, the user of a firearm will typically grasp the pivotal accessory support device 62, or the sighting device supported thereby, and apply a pulling or pushing force, depending on the mounting position of the mount base relative to the mounting rail 16 of the firearm. This pulling or pushing force will overcome the force of the compression spring and permit movement of the pivotal accessory support device 62 to its unlocked position. While maintaining the pulling or pushing force the pivotal accessory support device 62 will be rotated to or toward the desired position until the locking pin will have become engaged within a locking receptacle by the force of the compression spring.

For support of an optical or other sighting device or accessory, the pivotal accessory support device 62 defines a sight mount section 80 which defines a pair of mount ring structures 82 and 84, each being in the form of a mount ring half that is integral with or suitably fixed to the sight mount section 80. The mount ring structures 82 and 84 each define substantially semi-cylindrical internal surfaces 86 and 88 and are sufficiently flexible to permit spring-like deformation and clamping engagement thereof with the cylindrical outer surface of an auxiliary sighting device or other accessory 39. The mount ring structures 82 and 84 each also define clamp actuating sections 90 and 92 that are spaced and define a gap 94. Internally threaded inserts 96 and 98 composed of a relatively hard and stress resistant metal material, such as steel, are positioned within insert receptacles that are defined within the clamp section 92. Clamping screws are seated in corresponding inserts located within the clamp section 90 and are threaded into the inserts 96 and 98 to draw the clamp sections 90 and 92 toward one another, closing the gap 94 sufficiently to cause clamping support of the internal clamping surfaces 86 and 88 with the outer cylindrical surface of the auxiliary sighting device 39

Operation

A pivot mount base 42 having a lever actuated sight mount rail clamp mechanism according to the teachings of U.S. Pat. No. 7,272,904 of LaRue is assembled to a desired position on a Picatinny rail or other sight mount rail of a firearm and its locking lever is rotated from an unlocked or release position to a locking or clamping position to positively clamp the mount base to the rail. In the alternative, the pivot mount base may be assembled to a firearm mechanism according to conventional sight mounting practices.

After the pivot mount base has been assembled to the firearm mechanism, the pivotal accessory support device 62 and the sighting device 39 that is supported by the mount rings 82 and 84 thereof, are located at a precision sighting position. If the accessory support device 62 is not located and locked at the sighting position, manual force is applied to the accessory support device to move it linearly or rotationally or both linearly and rotationally relative to a pivot shaft 50 that is fixed with respect to the mount base. The user of the firearm will apply a manual pulling or pushing force to the accessory support device, depending on its orientation relative to the firearm, to overcome the force of a compression spring 74 and retract a locking pin 66 that is fixed to the accessory support device from a locking receptacle 70 that is defined by the mount base or an integral pivot projection 45 that extends from the mount base. This retracting movement of the accessory support device frees the accessory support device from its locked condition and permits the accessory support device to be rotated about the pivot shaft to align the locking pin 66 with a selected one of the locking receptacles. The locking receptacles are rotationally spaced by a maximum included angle of about 90°, with one of the locking receptacles having precision location with respect to the mount base 42 and the bore of the barrel of the firearm, so that engagement of the locking pin within the locking receptacle 70 will establish precision orientation of the sighting device that is supported by the accessory support device. At this position, the force of the compression spring will move the locking pin into the selected locking receptacle and secure the pivotal accessory support 62 and its sighting device 39 in immoveable relation with the mount base and the firearm mechanism.

When it is desired to move the accessory support device from the sighting position to a laterally offset, out-of-the-way position, such as to permit the independent use of a primary sighting device 30, the user of the firearm will simply again apply a manual unlocking force to the accessory support device or to the auxiliary sighting device 39. This manual unlocking force causes linear movement of the accessory support device relative to the pivot shaft 50 and the mount base 42 and unseats the locking pin 66 from the locking recess 70. The accessory support device is thus moved linearly against the force of its compression spring 74 to achieve unlocking and to permit the accessory support device to be rotated about the pivot shaft 50 from the aiming position to a laterally offset position. If desired, the accessory support device can be rotated sufficiently to position the locking pin 66 out of registry with the locking receptacle 70 and the manual unlocking force can be relaxed. This will cause spring urged engagement of the locking pin with the annular end surface 78 so that further rotational movement will cause the locking pin to slide along the end surface. When the second locking receptacle is encountered by movement of the locking pin in registry with it, the spring force will cause the locking pin to be driven into the locking recess to secure the accessory support device against further rotational movement. At this laterally offset position the sighting device will be secured against inadvertent movement, so that it will not move about and create noise.

Returning the accessory support device and its sighting device to the operative or aiming position, is simply accomplished by application of a spring force opposing manual force to the accessory support device, which causes further compression of the spring and extracts the locking pin from the locking receptacle. When the locking pin has been retracted clear of the locking receptacle, the accessory support device and its sighting device, are rotationally moved to the locking position for precision sighting of the firearm. At this point the retracting force is released, thus permitting the compression spring to again move the locking pin into secure locking relation within the locking receptacle.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. Therefore, the present embodiment is to be considered as merely illustrative and not restrictive, the scope of the invention being indicated by the claims, rather than the foregoing description, and all changes which come within the meaning and range of equivalence of the claims are therefore intended to be embraced therein.

I claim:

1. A pivot mount mechanism for a firearm sighting device, comprising:

a mount base adapted to be secured in substantially fixed relation on a firearm and having a pivot projection extending from said mount base and defining a pivot shaft receptacle and having a first lock member;

a pivot shaft being disposed in linearly and rotationally moveable relation within said pivot shaft receptacle of said pivot projection of said mount base and defining an external thread;

a sight support member having an internal thread in threaded engagement with said external thread and establishing a substantially immoveable connection of said sight support member and said pivot shaft, said sight support member being pivotally moveable to a sighting position and to a laterally offset non-sighting position;

said pivot projection defining a spring receptacle about said pivot shaft;

a spring member being located within said spring receptacle and applying spring force to said pivot projection and to said sight support member and urging said sight support member toward a position establishing releasable locking engagement of said first and second lock members; and a second lock member being disposed in fixed relation with said sight support member and being moveable into locking engagement with said first lock member and releasably securing said sight support member at said sighting position.

2. The pivot mount mechanism of claim 1, comprising:

said sight support member being disposed in both linearly and pivotally moveable relation with said mount base concurrently with linear and pivotal movement of said pivot shaft.

3. The pivot mount mechanism of claim 1, comprising:

said releasable locking engagement of said second lock member with said first lock member being released by application of force overcoming said spring force and moving said sight support member in an unlocking direction disengaging said releasable locking engagement of said first and second lock members and permitting rotation of said sight support member and said pivot shaft.

4. The pivot mount mechanism of claim 1, comprising:

said mount base being mounted to a firearm having a barrel defining a bore;

said pivot projection being a pair of spaced pivot projections defined by said mount base and each pivot projection having said pivot shaft receptacle defined therein, said pivot shaft receptacles having precision orientation in parallel relation with the bore of the firearm barrel, said pivot projection further defining a lock receptacle;

said sight support member being located between said spaced pivot projections having said pivot projection located therebetween;

said first lock member being a lock pin disposed in fixed relation within said lock receptacle of said mount base; and said second lock member being a locking recess defined by said sight support member and having a locking position with said locking recess in locking engagement within said lock pin and an unlocking position retracted from locking engagement within said lock pin.

5. The pivot mount mechanism of claim 1, comprising:

a sight mounting rail being present on the firearm; and a locking lever actuated clamp mechanism being defined by said mount base and responsive to selective locking lever movement establishing a clamping condition securing said mount base to the sight mounting rail and a release condition permitting separation of said mount base from the sight mounting rail.

6. The pivot mount mechanism of claim 1, comprising:

said sight support member having a predetermined axial dimension; and said mount base having spaced pivot projections having spacing greater than said predetermined dimension and being linearly and rotationally moveable with said pivot shaft and relative to said mount base.

7. The pivot mount mechanism of claim 1, comprising:

said first lock member being a locking pin of circular cross-sectional configuration; and said second lock member being a locking receptacle of generally U-shaped cross-section receiving said locking pin and establishing precision positioning of said sight support member at said sighting position.

8. A pivot mount mechanism for support and positioning of a sighting device of a firearm, comprising:

a mount base adapted to be secured in substantially fixed relation on a firearm and having opposed axial end surfaces establishing a defined axial dimension, said mount base further defining a pivot passage having spaced internal bearing surfaces and defining a locking receptacle;

a pivot shaft being fixed linearly and rotationally within said pivot passage of said mount base and defining spaced external bearing surfaces and having an external thread;

a pivotal accessory support device having an internal thread in substantially immoveable threaded engagement with said external thread of said pivot shaft and permitting linear and pivotal movement of said pivotal accessory support device and said pivot shaft and relative to said mount base;

a first lock member being disposed in fixed relation with said mount base;

a second lock member being disposed in fixed relation with said pivotal accessory support device and being positioned for locking engagement with said first lock member at a precision aiming position of said pivotal accessory support device; and a spring member applying spring force to said mount base and to said pivotal accessory support device urging said pivotal accessory support device to a position engaging said second lock member with said first lock member with said second lock member oriented at said precision aiming position.

9. The pivot mount mechanism of claim 8, comprising:

said mount base defining spaced pivot projections each having pivot pin receptacles therein collectively defining said pivot passage therein, said spaced pivot projections each having opposed surfaces establishing said defined axial dimension; and said pivotal accessory support device having less axial dimension than said defined axial dimension permitting linear movement of said pivotal accessory support device within said defined axial dimension; and said spaced pivot projections each having a bearing opening receiving said pivot shaft and establishing linear and rotational movement of said pivot shaft and said pivot accessory support device relative to said mount base to achieve locking and lock release positions of said pivot accessory support device.

10. The pivot mount mechanism of claim 8, comprising:

said pivot shaft having end portions defining substantially cylindrical bearing surfaces;

said spaced pivot projections of said mount base each defining a pivot passage receiving one of said substantially cylindrical bearing surfaces of said pivot shaft in rotatable and linearly moveable relation therein; and a spring receptacle being defined in said pivotal accessory support device and about said pivot shaft and having said spring member therein, said spring member continuously applying linear force urging said pivotal accessory support device toward said precision aiming position.

11. The pivot mount mechanism of claim 8, wherein a sight mounting rail is present on the firearm, said pivot mount mechanism comprising:

a locking lever actuated clamp mechanism being present on said mount base and being responsive to selective locking lever movement establishing a clamping condition securing said mount base to the sight mounting rail and establishing a release condition permitting separation of said mount base from the sight mounting rail.

12. A pivot mount mechanism for support and positioning of a sighting device of a firearm, comprising:

a mount base adapted to be secured in substantially fixed relation on a firearm;

a pair of spaced pivot projections extending from said mount base and having facing pivot projection surfaces establishing a pivot recess of defined axial dimension, each of said spaced pivot projections having a pivot opening therein defining an internal bearing surface, said pivot openings collectively defining a pivot passage;

a pivot shaft being linearly and rotationally moveable within said pivot passage of said pivot projections and defining spaced external bearing surfaces each having bearing engagement with said internal bearing surface, said pivot shaft defining an external thread;

a pivotal accessory support device having an axial length less than said defined dimension being linearly and rotationally moveable within said pivot recess and having a pivot shaft passage therein defining an internal thread establishing substantially immoveable threaded engagement with said external thread of said pivot shaft, said pivotal accessory support device and said pivot shaft having linear and pivotal permitting linear and pivotal movement of said pivotal accessory support device relative to said mount base;

angularly offset locking receptacles being defined by said pivotal accessory support device:

a lock member being disposed in fixed relation with said mount base and being positioned for locking engagement with a first of said locking receptacles at a precision aiming position of said pivotal accessory support device being positioned for locking engagement with a second of said locking receptacles at a laterally offset position of said pivotal accessory support device; and a spring member applying spring force to said mount base and to said pivotal accessory support device and urging said pivotal accessory support device toward a position engaging a selected one of said locking receptacles with said lock member at said precision aiming position and at said laterally offset position.

13. The pivot mount mechanism of claim 12, comprising:

a lock recess being defined by said mount base;

said lock member being a locking pin of circular cross-sectional configuration being fixed within said lock recess; and said locking receptacles each being of generally U-shaped cross-section being disposed to receive said locking pin in releasable locking relation therein and establishing precision positioning of said pivotal accessory support device at said sighting position.

14. The pivot mount mechanism of claim 12, comprising:

a spring receptacle being defined about said pivot passage of said pivotal accessory support device; and said spring member being located within said spring receptacle.

15. The pivot mount mechanism of claim 12, comprising:

said pivotal accessory support device being forcibly moveable linearly against said spring force to unseat said locking receptacle from said lock member and free said pivotal accessory support device for pivotal rotation to said aiming position and to said laterally offset position.

* * * * *